US008791930B2

(12) United States Patent
Jiang et al.

(10) Patent No.: US 8,791,930 B2
(45) Date of Patent: Jul. 29, 2014

(54) DEVICE AND METHOD FOR IMPROVING CONTRAST RATIO OF DISPLAY PANEL AND IMAGE DISPLAY SYSTEM

(75) Inventors: Jian-xun Jiang, Taipei (TW); Square Wang, Taichung (TW)

(73) Assignee: Innolux Corporation, Miao-Li County (TW)

( * ) Notice: Subject to any disclaimer, the term of this patent is extended or adjusted under 35 U.S.C. 154(b) by 775 days.

(21) Appl. No.: 12/571,368

(22) Filed: Sep. 30, 2009

(65) Prior Publication Data

US 2011/0074751 A1 Mar. 31, 2011

(51) Int. Cl.
*G09G 5/00* (2006.01)

(52) U.S. Cl.
USPC ..... 345/207; 345/690

(58) Field of Classification Search
None
See application file for complete search history.

(56) References Cited

U.S. PATENT DOCUMENTS

2003/0058211 A1 3/2003 Kim et al.
2006/0290618 A1* 12/2006 Goto ..... 345/77
2007/0152949 A1* 7/2007 Sakai ..... 345/102
2007/0290958 A1* 12/2007 Cok ..... 345/77
2010/0007593 A1* 1/2010 Mori et al. ..... 345/94
2010/0026731 A1* 2/2010 Konuma ..... 345/690
2010/0123651 A1* 5/2010 Miller et al. ..... 345/77
2012/0038865 A1 2/2012 Chiu et al.

FOREIGN PATENT DOCUMENTS

JP 4194818 7/1992
TW 200827824 12/1995

* cited by examiner

*Primary Examiner* — Joseph Haley
*Assistant Examiner* — Emily Frank
(74) *Attorney, Agent, or Firm* — Kirton McConkie; Evan R. Witt

(57) ABSTRACT

A contrast ratio improving device includes a controller and a photo detector. A contrast ratio improving method for use with a display panel includes the following steps. Firstly, multiple voltage values are applied to the display panel. Then, the brightness values corresponding to the voltage values applied to the display panel are detected. Afterwards, a voltage value corresponding to a specified value of the brightness values is selected as a peak voltage of the display panel. An image display system is also provided. The image display system includes a display panel and a memory. The memory stores a peak voltage obtained by the contrast ratio improving method.

13 Claims, 3 Drawing Sheets

DEVICE AND METHOD FOR IMPROVING CONTRAST RATIO OF DISPLAY PANEL AND IMAGE DISPLAY SYSTEM

FIELD OF THE INVENTION

The present invention relates to a contrast ratio improving device and a contrast ratio improving method for use with a display panel. The present invention also relates to an image display system having such a contrast ratio improving device and using such a contrast ratio improving method.

BACKGROUND OF THE INVENTION

A contrast ratio is a measure of a liquid crystal display (LCD) panel. When the LCD panel is in a dark room, the contrast ratio is defined as the ratio of the luminance value of the brightest color (white) to the luminance value of darkest color (black). As the brightness of the white color and the darkness of the black color are increased, the contrast ratio is increased. A high contrast ratio indicates a better image quality of the LCD panel. Nowadays, the LCD manufacturers make efforts in designing LCD panels with high contrast ratios.

FIG. 1 is a plot illustrating the relationship between the pixel voltage and the transmittance of a LCD panel. As shown in FIG. 1, a highest value of the transmittance values is observed when the applied pixel voltage is zero. As the applied pixel voltage is increased from zero to a reverse voltage (RV), the transmittance is decreased. A lowest value of the transmittance values is observed when the applied pixel voltage is equal to the reverse voltage. If the applied pixel voltage is increased from the reverse voltage, the transmittance is abruptly increased. Under this circumstance, a so-called "gray level inversion" occurs. The gray level inversion occurs in various LCD panels such as ECB (electrically controlled birefringence) mode LCD panels or TN mode+wide view film LCD panels.

Ideally, the contrast ratio is defined as the ratio of the luminance value obtained when the pixel voltage is zero to the luminance value when the pixel voltage is equal to the reverse voltage. In other words, a highest contrast ratio of the LCD panel is obtained when the maximum pixel voltage (i.e. the black voltage) is set to the reverse voltage. Due to the process variations of LCD panels, the relationships between the pixel voltage and the transmittance of different LCD panels are usually distinguished. For example, the Curve 1 has a first reverse voltage (RV1), the Curve 2 has a second reverse voltage (RV2), and the Curve 3 has a third reverse voltage (RV3). The first reverse voltage (RV1), the second reverse voltage (RV2) and the third reverse voltage (RV3) fall into a voltage range 10. For preventing from occurrence of the gray level inversion, the LCD manufacturers usually define a constant value below the lower limit of the voltage range 10 as the common black voltage of different LCD panels. In other words, there is a shift between the common black voltage and the reverse voltage. Under this circumstance, the obtained contrast ratio is not optimal.

Therefore, there is a need of providing a contrast ratio improving device and a contrast ratio improving method so as to obviate the drawbacks encountered from the prior art.

SUMMARY OF THE INVENTION

In accordance with an embodiment of the present invention, there is provided a contrast ratio improving method for use with a display panel. Firstly, multiple voltage values are applied to the display panel. Then, the brightness values corresponding to the voltage values applied to the display panel are detected. Afterwards, a voltage value corresponding to a specified value of the brightness values is selected as a peak voltage of the display panel.

In accordance with another embodiment of the present invention, there is provided a contrast ratio improving device for use with a display panel. The contrast ratio improving device includes a controller and a photo detector. The controller is electrically connected to the display panel for applying multiple voltage values to the display panel, so that the display panel exhibits multiple brightness values corresponding to the voltage values applied to the display panel. The photo detector is electrically connected to the controller for detecting the brightness values, converting the brightness values into corresponding electronic signals, and transmitting the electronic signals to the controller. According to the electronic signals, the controller selects a voltage value corresponding to a specified value of the brightness values as a peak voltage of the display panel.

In accordance with another embodiment of the present invention, there is provided an image display system. The image display system includes a display device and a power supply. The display device has a display panel and the contrast ratio improving device of the present invention. The power supply is electrically connected to the display device for providing electric energy to power the display device.

In accordance with another embodiment of the present invention, there is provided an image display system. The image display system includes a display panel, a memory and a power supply. The memory stores a peak voltage obtained by the contrast ratio improving method of the present invention. The power supply is electrically connected to the display panel for providing electric energy to power the display panel.

BRIEF DESCRIPTION OF THE DRAWINGS

The above contents of embodiments of the present invention will become more readily apparent to those ordinarily skilled in the art after reviewing the following detailed description and accompanying drawings, in which.

DETAILED DESCRIPTION OF EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
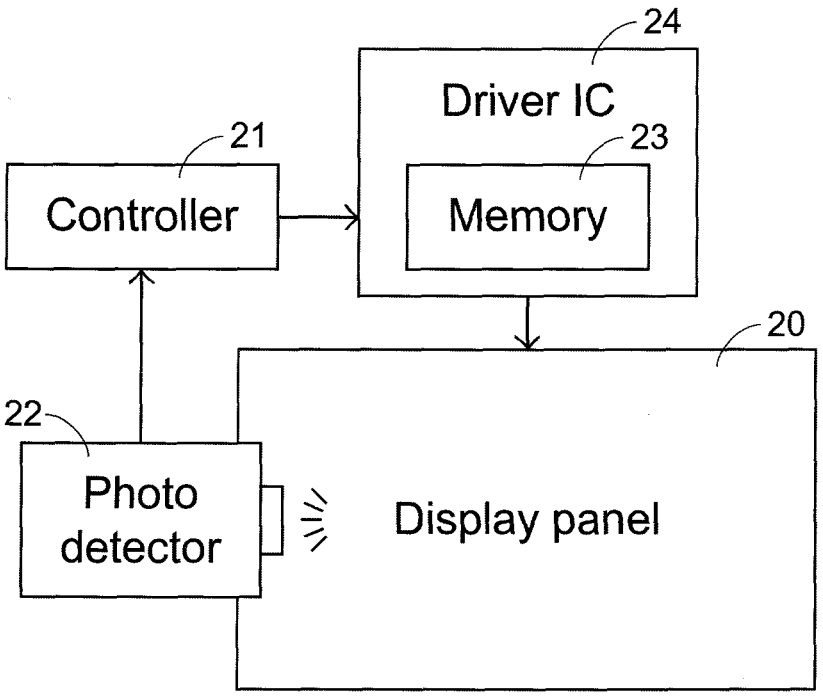
FIG. 2 is a schematic functional block diagram illustrating a contrast ratio improving device according to an embodiment of the present invention.

FIG. 2 is a schematic functional block diagram illustrating a contrast ratio improving device according to an embodiment of the present invention. The contrast ratio improving device is applied to a display panel 20. The contrast ratio improving device includes a controller 21, a photo detector 22 and a memory 23. The controller 21 is electrically connected to the display panel 20 through a driver IC 24. The controller 21 provides multiple voltage values to the driver IC 24, so that the display panel 20 is driven by the driver IC 24. According to these voltage values, the display panel 20 will exhibit different brightness values.

Figure 1:
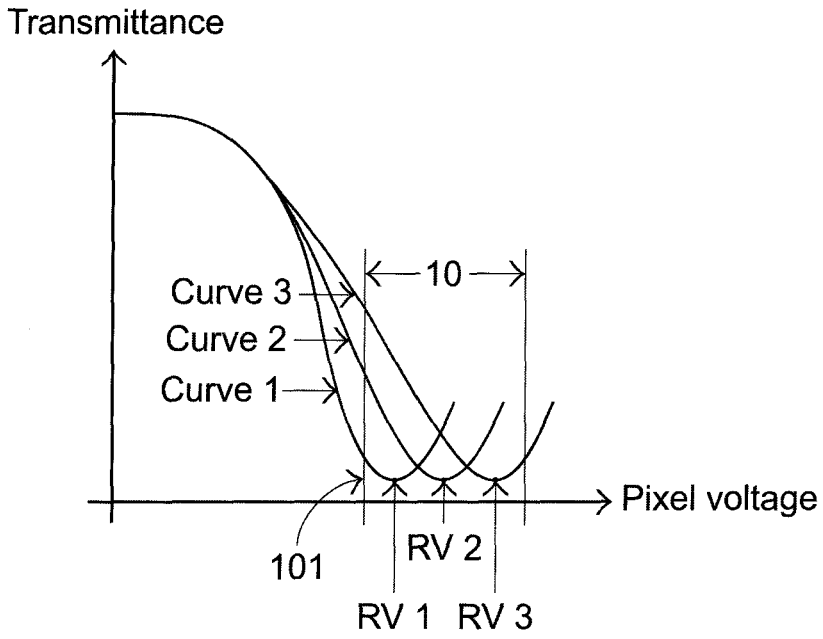
FIG.1 PRIOR ART
FIG. 1 is a plot illustrating the relationship between the pixel voltage and the brightness of a LCD panel.

If these voltage values fall into the voltage range 10 as shown in FIG. 1, the display panel 20 will exhibit a black screen of different brightness values. When the brightness values are detected by the photo detector 22, the photo detector 22 will convert the brightness values into corresponding electronic signals and transmit the electronic signals to the controller 21. The controller 21 will select a voltage value corresponding to a specified value (e.g. a minimum value) of the brightness values as a black voltage of the display panel 20. The specified value indicative of the black voltage is then stored into the memory 23. In this embodiment, the memory 23 is included in the driver IC 24. During operation of the display panel 20, the driver IC 24 will read the specified value from the memory 23 so as to acquire an optimal black voltage of the display panel 20. According to the optimal black voltage, the display panel 20 will exhibit an optimal contrast ratio. In other words, since the contrast ratio improving device is capable of acquiring an optimal black voltage of individual display panel, the contrast ratio of individual display panel is improved.

Figure 3:
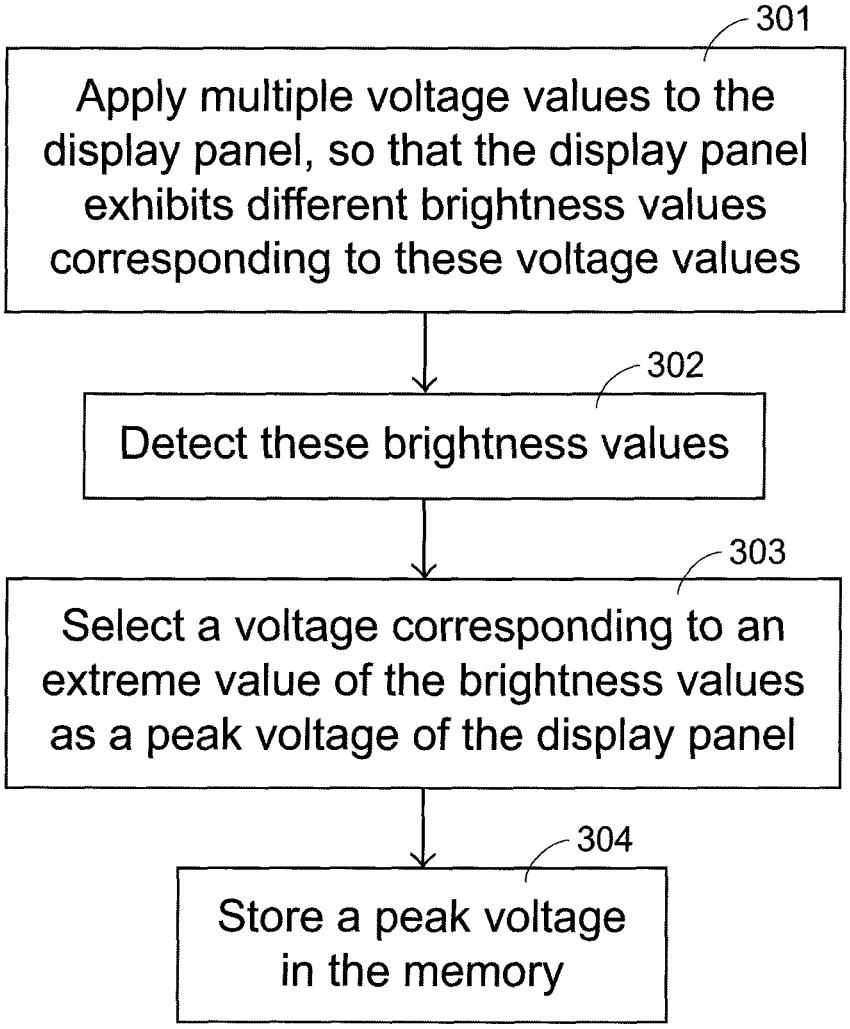
FIG. 3 is a flowchart illustrating a contrast ratio improving method of the present invention.

FIG. 3 is a flowchart illustrating a contrast ratio improving method of the present invention. First of all, multiple voltage values are applied to the display panel (Step 301). Corresponding to these voltage values, the display panel will exhibit different brightness values. Next, these brightness values are detected (Step 302). Next, a voltage corresponding to an extreme value of the brightness values is selected as a peak voltage of the display panel (Step 303). The peak voltage is stored in the memory (Step 304). According to the peak voltage, the contrast ratio of the display panel can be improved.

In a case that the display panel 20 is a normally white LCD panel, the extreme value of the brightness values is the minimum value of the brightness values and the peak voltage is a black voltage. In response to the voltage ranged from zero to the peak voltage (i.e. the black voltage), the driver IC 24 will drive the normally white LCD panel to exhibit multiple values of the brightness values. Whereas, in a case that the display panel 20 is a normally black LCD panel, the extreme value of the brightness values is the maximum value of the brightness values and the peak voltage is a white voltage. In response to the voltage ranged from zero to the peak voltage (i.e. the white voltage), the driver IC 24 will drive the normally black LCD panel to exhibit multiple values of the brightness values.

Figure 4:
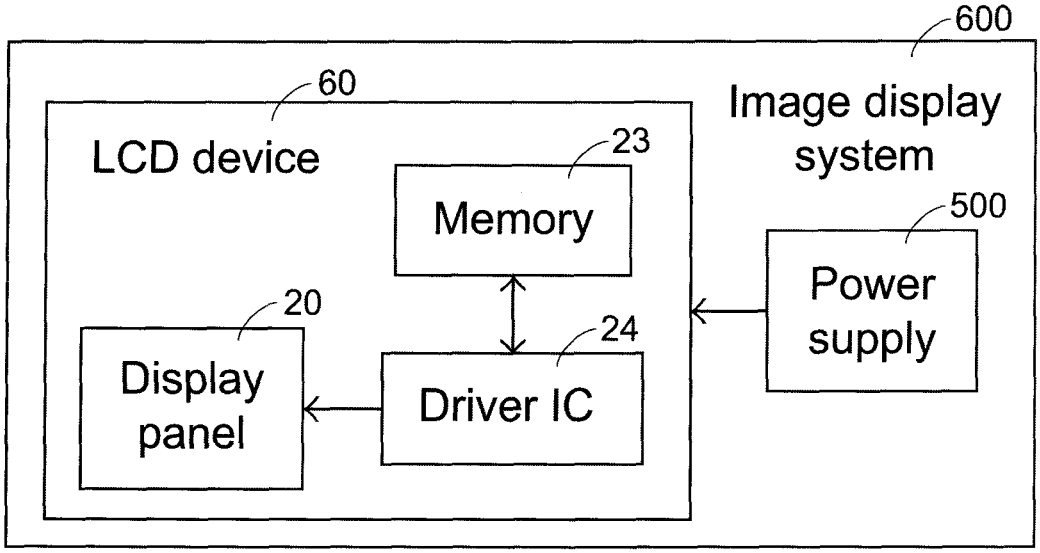
FIG. 4 is a schematic functional block diagram illustrating an image display system of some embodiments of the present invention.

FIG. 4 is a schematic functional block diagram illustrating an image display system of some embodiments of the present invention. The image display system 600 comprises a LCD device 60 and a power supply 500. The LCD device 60 includes a display panel 20, a memory 23 and a driver IC 24. The contrast ratio improving device is integrated into the display panel 20. The memory 23 has previously stored the peak value obtained by the contrast ratio improving method of the present invention. The driver IC 24 drives the display panel 20 to exhibit different values of the brightness values. The power supply apparatus 500 is electrically connected to the LCD device 60 for providing electric energy to the LCD device 60.

The memory 23 is for example a non-volatile memory such as an erasable non-volatile memory (e.g. a flash memory) or a one-time programming (OTP) non-volatile memory. The memory 23 can be integrated into the driver IC 24 or other IC. Alternatively, the memory 23 can be separated from the driver IC 24. An example of the image display system 600 includes but is not limited to a mobile phone, a digital camera, a personal digital assistant, a notebook computer, a desktop computer, a TV set, a global positioning system (GPS), an automotive display system, a flight display system, a digital photo frame, a portable DVD player, and the like. Some embodiments of the present invention are illustrated by referring to a LCD device. Nevertheless, the present invention is applicable to other display device such as an organic light emitting diode (OLED) device.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A contrast ratio improving method for use with a liquid crystal display panel, the contrast ratio improving method comprising steps of:

applying multiple voltage values to the liquid crystal display panel;

detecting brightness values corresponding to the voltage values applied to the liquid crystal display panel; and selecting, among the voltage values in a reverse voltage region, a voltage value corresponding to a minimum value of the brightness values as a black voltage of the liquid crystal display panel.

2. The contrast ratio improving method according to claim 1 further comprising a step of storing the black voltage in a memory.

3. The contrast ratio improving method according to claim 2, further comprising, during operation of the display panel, reading the stored black voltage from the memory, and driving the liquid crystal display panel in a voltage range from zero to the black voltage read out from the memory.

4. The contrast ratio improving method according to claim 1, further comprising:

during operation of the liquid crystal display panel, driving the liquid crystal display panel in a voltage range from zero to the black voltage selected at said selecting.

5. A contrast ratio improving device for use with a liquid crystal display panel, the contrast ratio improving device comprising:

a controller electrically connected to the liquid crystal display panel, the controller configured to apply multiple voltage values to the liquid crystal display panel, so that the liquid crystal display panel exhibits multiple brightness values corresponding to the voltage values applied to the liquid crystal display panel;

a photo detector electrically connected to the controller, the photo detector configured to detect the brightness values, convert the brightness values into corresponding electronic signals, and transmit the electronic signals to the controller, wherein the controller is configured to, according to the electronic signals, select, among the voltage values in a reverse voltage region, a voltage value corresponding to a minimum value of the brightness values as a black voltage of the liquid crystal display panel.

6. The contrast ratio improving device according to claim 5, further comprising a memory configured to store the black voltage.

7. The contrast ratio improving device according to claim 6, wherein the memory is a non-volatile memory.

8. The contrast ratio improving device according to claim 7, wherein the non-volatile memory is an erasable non-volatile memory.

9. The contrast ratio improving device according to claim 7, wherein the non-volatile memory is a one-time programmable non-volatile memory.

10. An image display system, comprising:

a display device having a liquid crystal display panel and the contrast ratio improving device according to claim 5; and a power supply electrically connected to the liquid crystal display device, the power supply configured to supply electric energy to power the liquid crystal display device.

11. The image display system according to claim 10, wherein the image display system is a mobile phone, a digital camera, a personal digital assistant, a notebook computer, a desktop computer, a TV set, a global positioning system, an automotive display system, a flight display system, a digital photo frame or a portable DVD player.

12. The image display system according to claim 10, wherein the contrast ratio improving device is integrated into the liquid crystal display panel.

13. An image display system, comprising:

a liquid crystal display panel;

a memory storing the black voltage obtained by a contrast ratio improving method, the contrast ratio improving method comprising the steps of: applying multiple voltage values to the liquid crystal display panel; detecting brightness values corresponding to the voltage values applied to the liquid crystal display panel; and selecting, among the voltage values, in a reverse voltage region, a voltage value corresponding to a minimum value of the brightness values as a black voltage of the liquid crystal display panel; and a power supply electrically connected to the liquid crystal display panel, the power supply configured to supply electric energy to power the liquid crystal display panel.

* * * * *